US007172413B2

(12) United States Patent
Han et al.

(10) Patent No.: US 7,172,413 B2
(45) Date of Patent: Feb. 6, 2007

(54) LAUNDRY DRYER HAVING GAS COMBUSTION APPARATUS

(75) Inventors: In Hee Han, Changwon-si (KR); Seong Hai Jeong, Changwon-si (KR); Soo Won Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 236 days.

(21) Appl. No.: 10/725,934

(22) Filed: Dec. 3, 2003

(65) Prior Publication Data

US 2004/0161720 A1 Aug. 19, 2004

(30) Foreign Application Priority Data

Dec. 5, 2002 (KR) ..... 10-2002-0077009

(51) Int. Cl.
*F23D 14/70* (2006.01)
*F23D 14/84* (2006.01)

(52) U.S. Cl. ..... 431/350; 431/354; 431/264; 431/265; 431/266; 239/504; 239/518

(58) Field of Classification Search ..... 431/10, 431/258, 263, 264, 265, 266, 354, 355, 349, 431/347, 116, 346, 350; 239/500, 504, 498, 239/499, 502, 211.11–224, 223, 518
See application file for complete search history.

(56) References Cited

U.S. PATENT DOCUMENTS

| | | | | | |
|---|---|---|---|---|---|
| 790,714 | A * | 5/1905 | Bray | 239/553.5 |
| 1,863,100 | A * | 6/1932 | Coleman | 239/407 |
| 2,121,948 | A * | 6/1938 | Borland | 431/349 |
| 2,187,674 | A * | 1/1940 | Anderson et al. | 239/553.5 |
| 2,558,057 | A * | 6/1951 | Mun | 239/407 |
| 2,646,109 | A * | 7/1953 | Banscher | 431/350 |
| 2,905,235 | A * | 9/1959 | Dolby | 431/349 |
| 3,198,238 | A * | 8/1965 | Highes | 431/349 |
| 3,251,393 | A * | 5/1966 | Beach et al. | 431/3 |
| 3,574,506 | A * | 4/1971 | Locke | 431/349 |
| 3,685,949 | A * | 8/1972 | Greaves | 431/349 |
| 3,915,623 | A * | 10/1975 | Wormser | 431/347 |
| 4,052,141 | A * | 10/1977 | Dudheker et al. | 431/167 |
| 4,111,642 | A * | 9/1978 | Kopp | 431/347 |
| 4,284,402 | A * | 8/1981 | Sheets et al. | 431/9 |
| 4,434,976 | A * | 3/1984 | Murakami et al. | 266/268 |
| 4,526,535 | A * | 7/1985 | Wunderlich | 432/105 |
| 5,083,917 | A * | 1/1992 | McCullough et al. | 432/209 |
| 5,186,620 | A * | 2/1993 | Hollingshead | 431/354 |
| 5,244,381 | A * | 9/1993 | Cahlik | 431/171 |
| 5,433,602 | A * | 7/1995 | Sigler | 431/286 |
| 5,865,256 | A * | 2/1999 | Pounder | 169/37 |
| 6,036,481 | A * | 3/2000 | Legutko et al. | 431/354 |
| 6,138,586 | A * | 10/2000 | Reichart | 110/211 |
| 6,190,163 | B1 * | 2/2001 | Maricic et al. | 431/354 |

* cited by examiner

*Primary Examiner*—Carl D. Price
(74) *Attorney, Agent, or Firm*—Fleshner & Kim LLP

(57) ABSTRACT

A gas combustion apparatus of a laundry dryer is provided, by which an initial ignition power is improved to enhance an ignition property. The gas combustion apparatus includes a gas supply; a mixing pipe, having a mixing passage extending from an inlet end to an outlet end, for mixing the supplied gas with primary air, the primary air and gas entering the mixing passage at the inlet end and a gas-and-air mixture exiting the mixing passage at the outlet end; and a flame holder, disposed at the outlet end of the mixing pipe, for separating the gas-and-air mixture exiting the mixing pipe into a complex plurality of jetted streams.

17 Claims, 6 Drawing Sheets

LAUNDRY DRYER HAVING GAS COMBUSTION APPARATUS

This application claims the benefit of Korean Application No. 10-2002-0077009 filed on Dec. 5, 2002, which is hereby incorporated by reference.

BACKGROUND OF THE INVENTION

1. Field of the Invention

The present invention relates to a laundry dryer, and more particularly, to a laundry dryer having a gas combustion apparatus employing a flame holder for separating the flame exiting a mixing pipe.

2. Discussion of the Related Art

A typical laundry dryer performs drying using hot air, which is drawn into a drying chamber through an inlet duct, under the power of a blower installed adjacent an outlet pipe, to be discharged from the drying chamber via a lint-filtering unit. The hot air may be generated by means of an electric heater or gas combustion. A gas dryer employs a gas combustion apparatus.

Referring to FIG. 1, illustrating major components of a gas-combustion laundry dryer according to a related art, a cylindrical drum 1 together with front and rear supports 7 and 9 essentially establishes a drying chamber 5 in which drying is performed. A blower 17 is powered to discharge the drying air from the drum 1 via an outlet assembly 13 including a lint filter 14, which are installed on the front side of the front support 7, and a lint duct 15 receiving the lint filter and communicating with the outlet assembly. The blower 17, mounted within a blower housing 18, is connected to the lint duct 15 and draws air from the drying chamber 5 for discharge via an outlet pipe 19 communicating with the blower housing.

An air inlet duct 12, installed on the rear side of the rear support 9 to communicate with the drying chamber 5, supplies hot air to the drying chamber. One end of a guide funnel 20 is tapered for connection to the inlet duct 12 at its entrance hole to guide hot air into the inlet duct.

Referring to FIG. 2, the other end (mouth) of the guide funnel 20 receives a length of a mixing pipe 24 for mixing primary air, i.e., external air entering through the inlet end of the mixing pipe, with gas injected from a gas nozzle 2. Thus, the outlet of the mixing pipe 24 extends a predetermined distance into the mouth of the guide funnel 20 while the gas nozzle 22, under the control of a valve 30, is disposed at its inlet to inject gas into the mixing pipe. The valve 30 thus controls the amount of gas introduced to the gas nozzle 22 via a gas supply pipe 23, which is connected a gas supply source (not shown). Accordingly, the gas from the gas nozzle 22 is controllably mixed with the primary air in a mixing passage 240 of the mixing pipe 24, which has a tapered circular cross-section. A spark plug 26 is installed at one side of the outlet of the mixing pipe 24, which, to ignite the gas-and-air mixture and thereby initiate a state of a gas combustion for generating the hot air to be guided into the inlet duct 12 by the guide funnel 20.

In the operation of a laundry dryer as constructed above, the blower 17 is actuated to drawn in the air in the drying chamber 5 via the lint duct 15, thus creating a pressure differential causing air to flow into the drying chamber via the inlet duct 12. The air flowing into the inlet duct 12 is heated to a high temperature by the gas combustion apparatus. Namely, gas is injected into the mixing pipe 24 via the gas nozzle 22, and the primary air flows into the inlet of the mixing pipe 24 to be mixed with the gas therein. The gas-and-air mixture is then ignited by the spark plug 26 provided at the outlet of the mixing pipe 24, and combustion begins. Heat energy generated from the combustion of the gas heats the air flowing through the guide funnel 20, i.e., secondary air, and the thus-generated hot air is supplied to the entrance hole of the inlet duct 12.

Referring to FIG. 3, the circular cross-section of the outlet end of the mixing pipe 24 produces a contiguous flame having a generally elongated shape. The diameter and length of the flame, as well as its separation from the outlet end of the mixing pipe 24, vary according to operational parameters of the blower 17, such as its rotational speed and exhaust resistance, determining a state of balance between the gas combustion and the inflowing air. If the speed of the blower 17 is properly controlled, a flame F is formed near the outlet end of the mixing pipe 24, but if the blower speed is too high, the resulting flame formation is a flame F' separated (called "lifting") from the outlet end of the mixed pipe. If the rotational speed of the blower 17 is too low, the resulting flame formation is excessively elongated. A long flame may reach into the inlet duct 12 to cause overheating or may even reach into the drying chamber 5 and cause a fire. Therefore, blower parameters must be carefully controlled to prevent an imbalance between the combustion rate of the gas and the amount of air intake. Such control of the blower is difficult, and failure may be catastrophic.

Moreover, the contiguous formation of the combustion flame F resulting from is circular cross-section of the outlet of the mixing pipe 24 limits the contact area between the flame and the secondary air entering the guide funnel 20. Heating efficiency is a direct result of size of the flame-to-secondary air contact area. The reduced contact area also results in incomplete combustion due to an insufficient supply of secondary air to the flame, which produces an elongated, yellow flame producing excessive amounts of soot and toxic gases such as CO, $NO_x$, and $SO_x$.

In addition, there is a tendency at the time of initial ignition by the spark plug 26 for the gas-and-air mixture within the mixing pipe 24 to escape from its outlet end, without combustion, thus lowering ignition capability.

SUMMARY OF THE INVENTION

Accordingly, the present invention is directed to a laundry dryer having a gas combustion apparatus that substantially obviates one or more of the problems due to limitations and disadvantages of the related art.

An object of the present invention, which has been devised to solve the foregoing problem, lies in providing a laundry dryer having a gas combustion apparatus, by which an initial ignition power is improved to enhance an ignition property.

It is another object of the present invention to provide a laundry dryer having a gas combustion apparatus, by which the length of a flame of gas combustion is reduced and the introduction of secondary air is increased.

It is another object of the present invention to provide a laundry dryer having a gas combustion apparatus, by which a main flame exiting a mixing pipe is separated into a plurality of resultant flames to facilitate a mixing of the flame with secondary air.

It is another object of the present invention to provide a laundry dryer having a gas combustion apparatus, by which a stable, high-temperature flame is produced while preventing backfiring.

It is another object of the present invention to provide a laundry dryer having a gas combustion apparatus, by which complete combustion is achieved.

It is another object of the present invention to provide a laundry dryer having a gas combustion apparatus, by which combustion is accelerated.

It is another object of the present invention to provide a laundry dryer having a gas combustion apparatus, by which lifting and overheating conditions are prevented.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a laundry dryer having a gas combustion apparatus. The apparatus comprises means for supplying gas; a mixing pipe, having a mixing passage extending from an inlet end to an outlet end, for mixing the gas supplied by the gas supplying means with primary air, the primary air and gas entering the mixing passage at the inlet end and a gas-and-air mixture exiting the mixing passage at the outlet end; and a flame holder, disposed at the outlet end of the mixing pipe, for separating the gas-and-air mixture exiting the mixing pipe into a complex plurality of jetted streams.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings. Throughout the drawings, like elements are indicated using the same or similar reference designations where possible.

Figure 1:
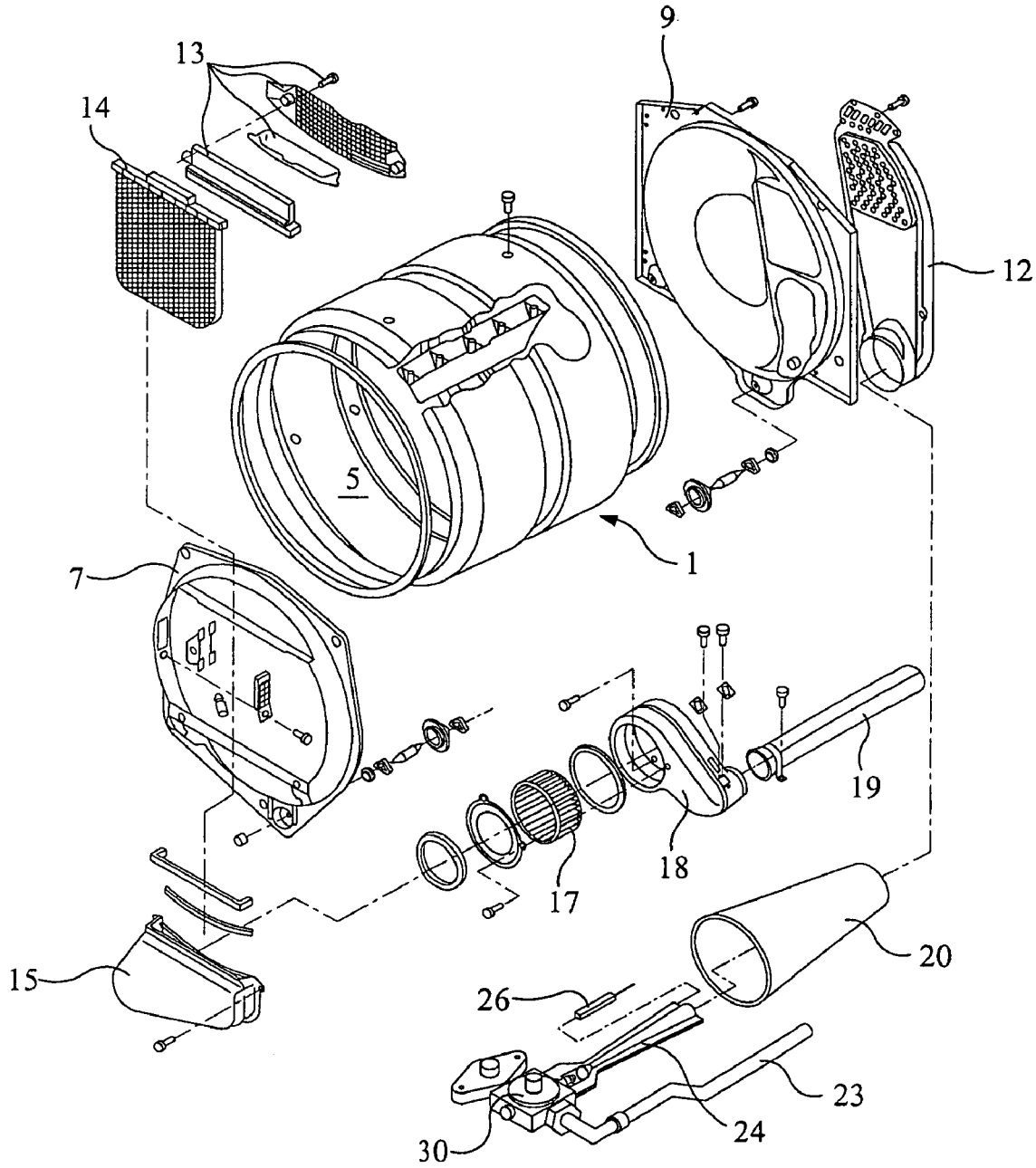
FIG. 1 Related Art
FIG. 1 is an exploded perspective view of a general gas dryer.
Figure 2:
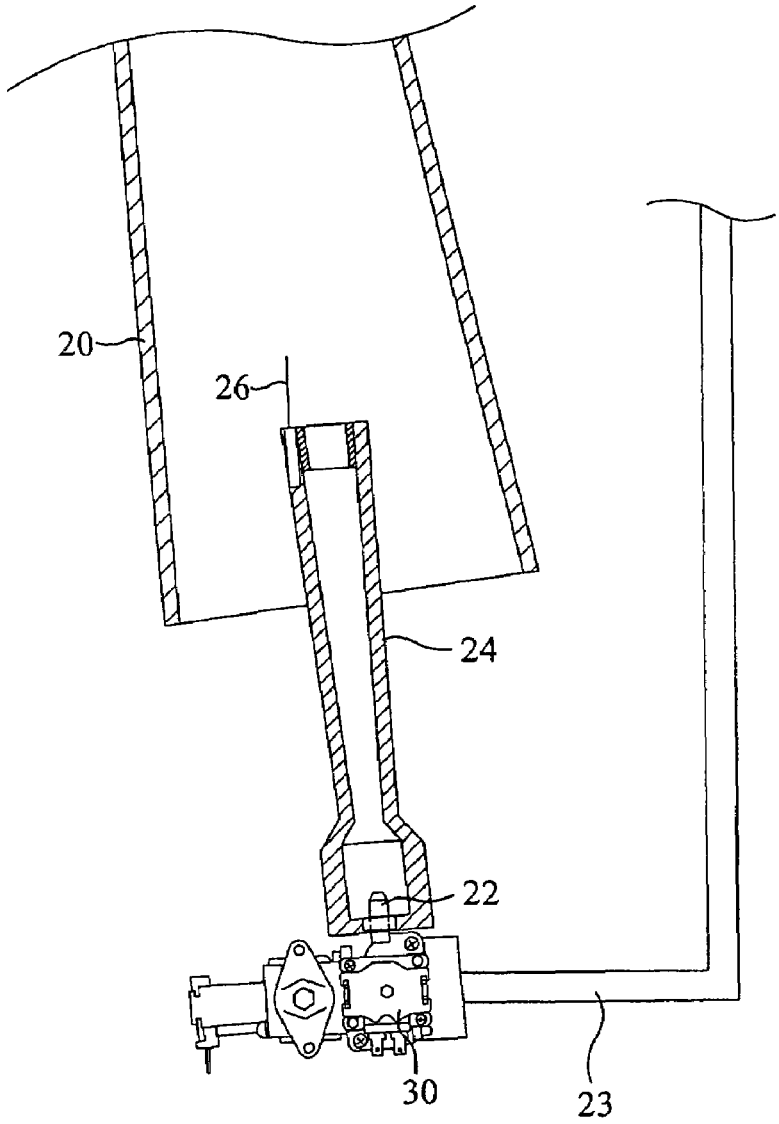
FIG. 2 Related Art
FIG. 2 is a partial cutaway view of a gas combustion apparatus of a laundry dryer according to a related art.
Figure 3:
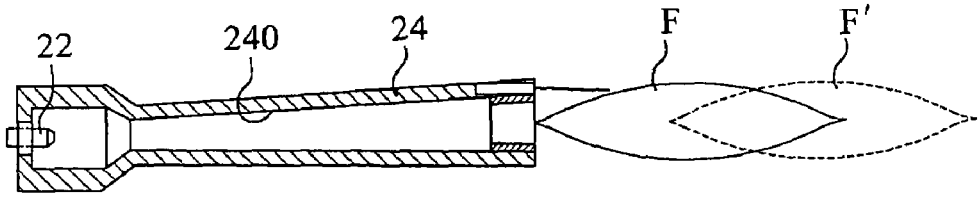
FIG. 3 Related Art
FIG. 3 is a cross-sectional view of the mixing pipe of the gas combustion apparatus of FIG. 2.
Figure 4:
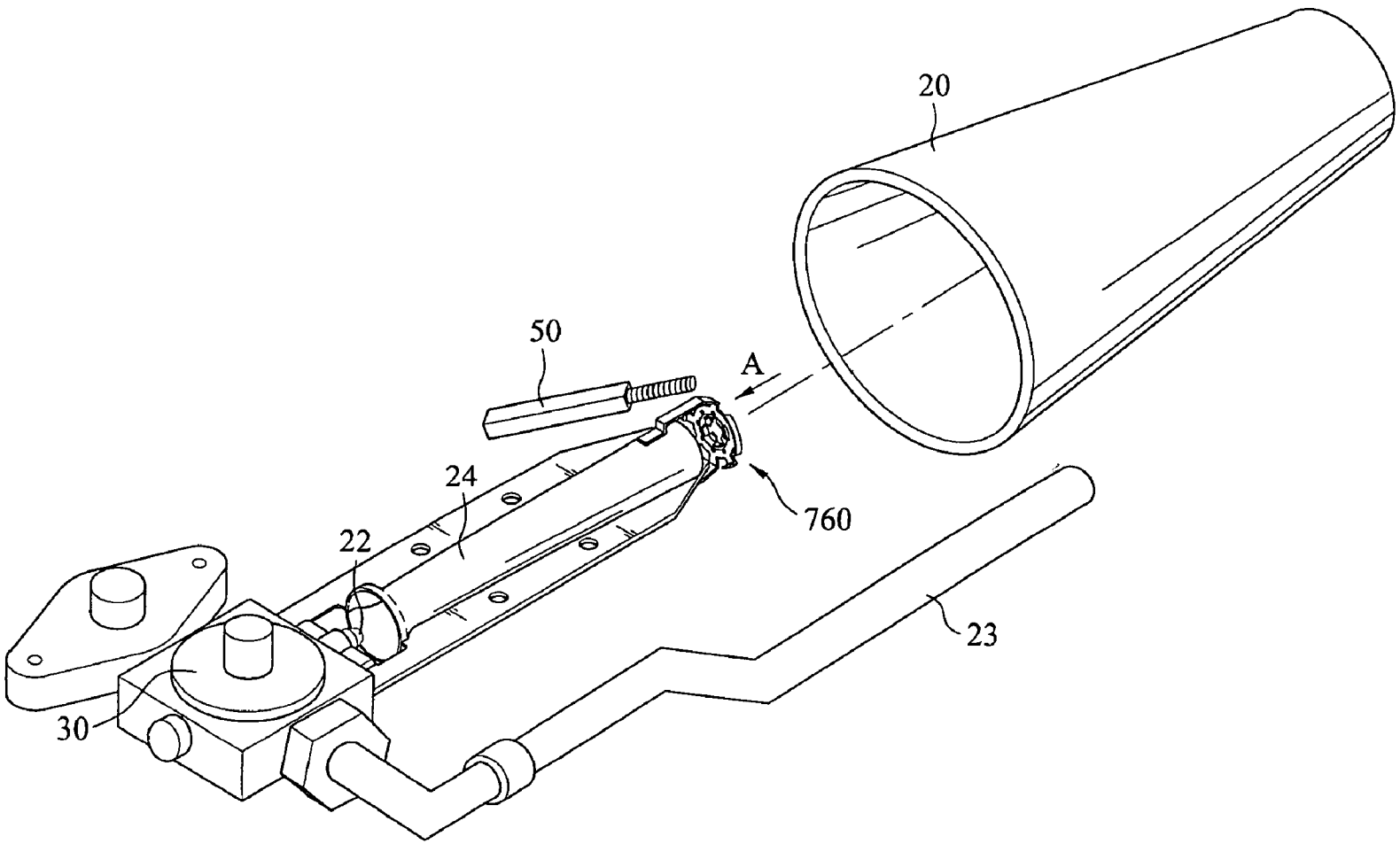
FIG. 4 is an exploded perspective view of a gas combustion apparatus of a laundry dryer according to a preferred embodiment of the present invention.
Figure 5:
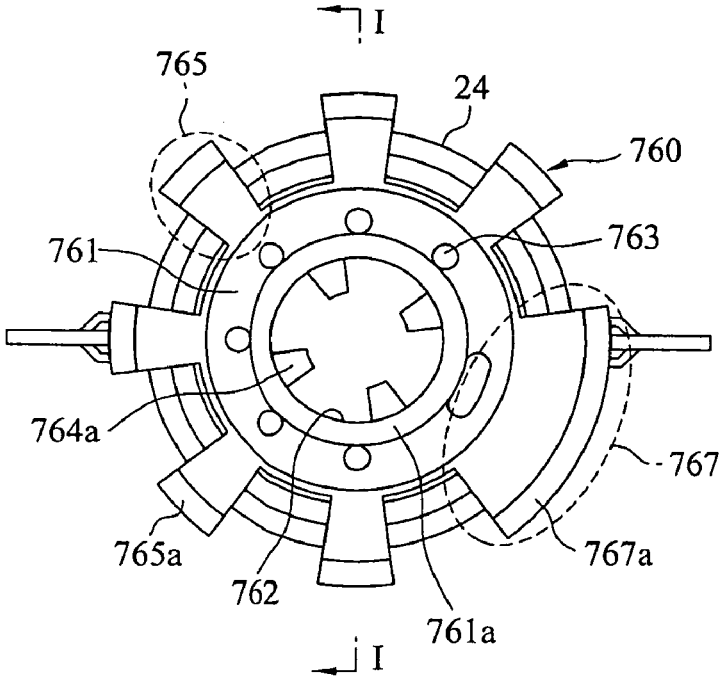
FIG. 5 is a front view (in a direction "A" of FIG. 4) of the flame holder and mixing pipe shown in FIG. 4.
Figure 6:
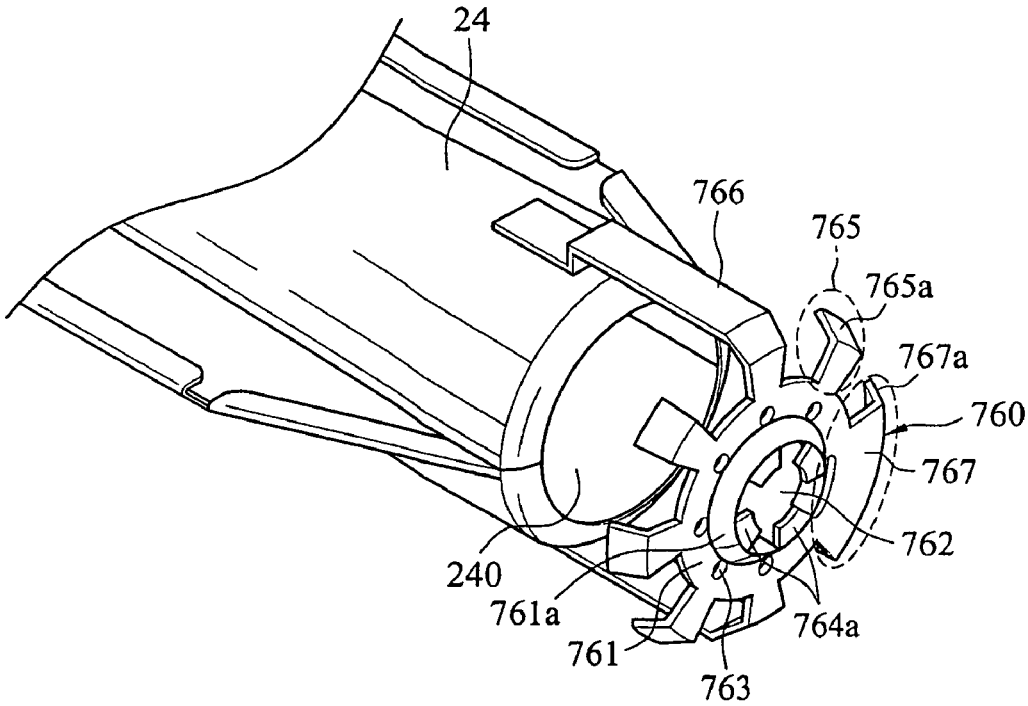
FIG. 6 is a perspective view of the outlet end of the mixing pipe as shown in FIG. 4.
Figure 7:
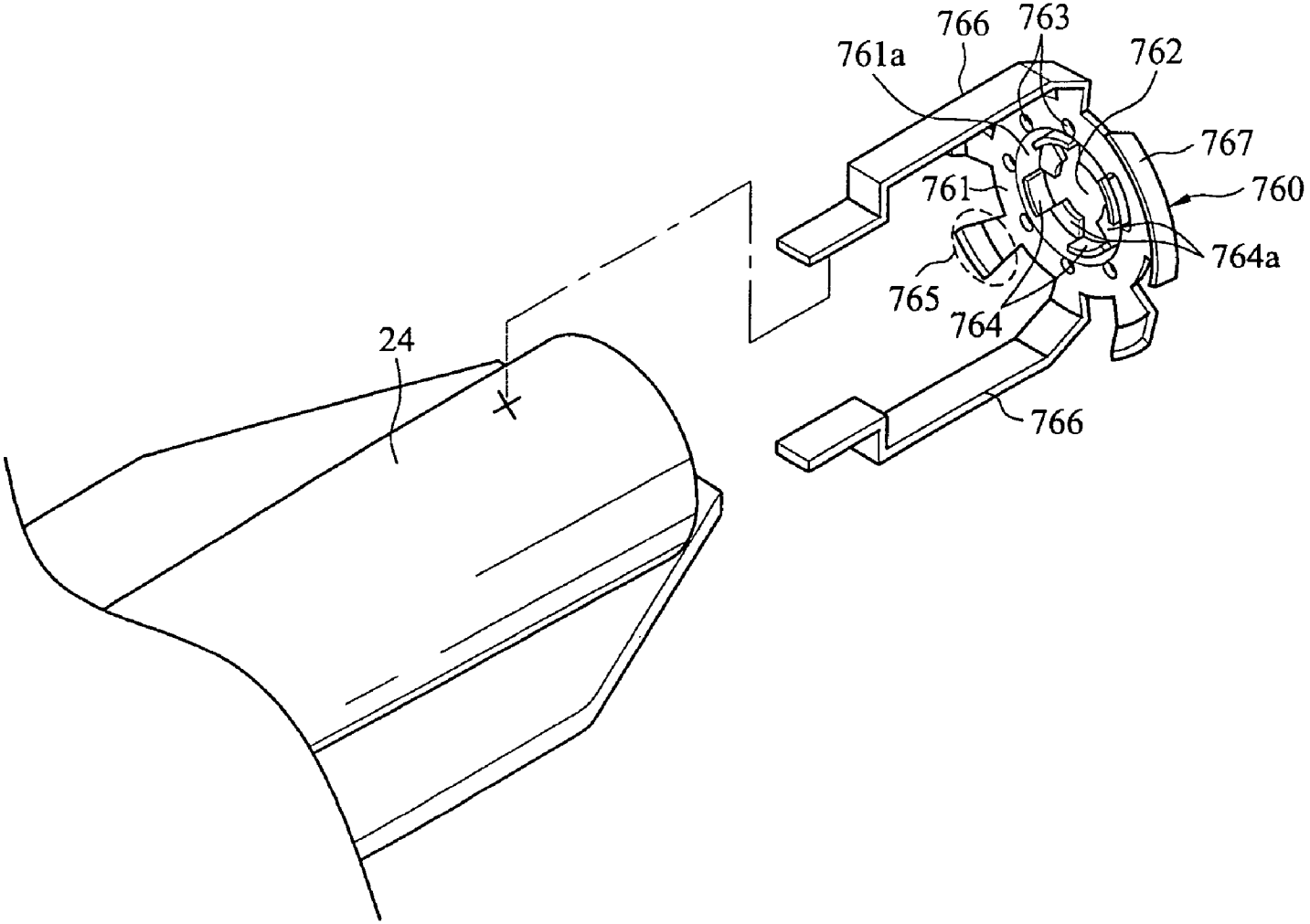
FIG. 7 is an exploded perspective view of the outlet end of the mixing pipe as shown in FIG. 4.
Figure 8:
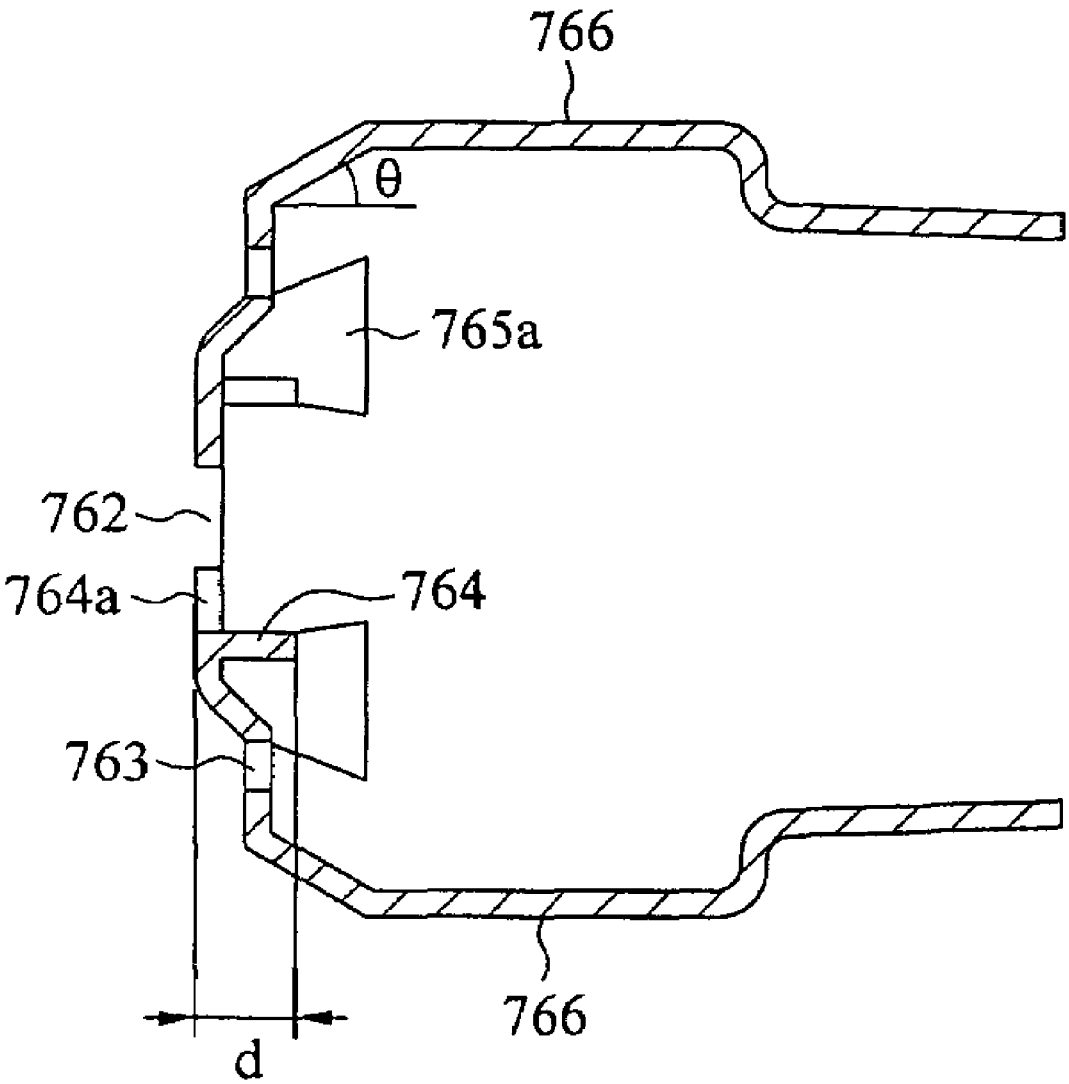
FIG. 8 is a cross-sectional view of the flame holder shown in FIG. 5, taken along a line I—I.

Referring to FIG. 4, illustrating a gas combustion apparatus for use in a laundry dryer according to the present invention, a gas supply pipe 23 for supplying gas is connected to a gas nozzle 22 from which the gas is injected into a mixing pipe 24 under the control of a valve 30 for controlling the amount of gas supplied to the gas nozzle. The mixing pipe 24, disposed in front of the gas nozzle 22, has a mixing passage 240 having tapered cross-section for mixing primary air with the gas injected from the gas nozzle. Thus, the gas-and-air mixture flows into the mixing pipe's smaller inlet end, along the mixing passage 240, and exits through its larger outlet end to be directed toward a guide funnel 20. An igniter 50, such as a ceramic spark plug receiving a current signal for ignition, is disposed adjacent the outlet end to ignite the gas-and-air mixture exiting the mixing passage 240 of the mixing pipe 24, and may be attached to the mixing pipe or may be separately supported. A flame holder 760 for separating the flame produced by the igniter 50 is mounted in front of the outlet end of the mixing pipe 24. After installation, the orientation of the mixing pipe 24 within the laundry dryer is inclined at a predetermined angle upward, from the inlet end to the outlet end, to facilitate the propagation of the flame.

Referring to FIGS. 5—8, the flame holder 760 of the gas combustion apparatus of the present invention comprises an annular hub 761 and a plurality of outer wings 765 and 767 radiating from the annular hub and having a predetermined interval. A pair of support arms 766 extend from opposite sides of the annular hub 761 to be fixed to the outer surface of the mixing pipe 24, such that the flame holder 760 is disposed at a predetermined distance forward of the outlet end of the mixing pipe. A center flame hole 762 is formed at the center of the annular hub 761, and a plurality of outer flame holes 763 are formed at a predetermined interval around the center flame hole. The annular hub 761 comprises a rounded inner edge 761*a* protruding forwardly from the center of the flame holder 760 toward the guide funnel 20, i.e., in the direction of the flame, and a plurality of inner wings extending inwardly from the inner circumference of the rounded inner edge. The inner wings include a plurality of rearward bosses 764 each having a predetermined length d extending directly toward the mixing pipe 24, and a plurality of inward bosses 764*a* extending toward the center of the annular hub 761 to retard a backfiring of the flame. The inward bosses 764*a* may be formed by cutting away predetermined portions of the material forming the rearward bosses 764 and spreading out the cut portions to be directed inward, such that the circumferential widths of the rearward and inward bosses fully occupy the inner circumference of the rounded inner edge 761*a*. The outer wings 765 and 767 comprise bent portions 765*a* and 767*a*, respectively, which are formed at the distal ends of the outer wings to be directed back toward the mixing pipe 24 and are inclined at a predetermined angle θ with respect to a central axis of the mixing pipe and the annular hub 761.

The predetermined angle θ of the bent portions 765*a* and 767*a* is preferably 10°~30°. The arc of the outer wing 767 along the circumference of the annular hub 761, which is positioned to correspond to the position of the igniter 50, is at least twice that of any outer wing 765. The positioning of the outer flame holes 763 on the annular hub 761 correspond to the outer wings 765 and 767, with one flame hole being elongated to correspond to the wide outer wing 767, and the inward bosses 764*a* are respectively disposed between the outer wings. Optimum dimensions of the flame holder 760, including the diameter of the center flame hole 762 and the surface areas of the outer wings 765 and 767, are determined based on operational results of a laundry dryer adopting the present invention.

The flame holder 760 of the present invention facilitates the burning of the jetted mixture of gas and primary air from the mixing passage 240, such that a main flame is formed by the mixture jetting from the center flame hole 762 and around the annular hub 761. The main flame is separated into a plurality of resultant flames by the outer flame holes 763, the gaps of the outer wings 765 and 767, and the gaps of the inner wings 764*a* and 764. The surface area of the resultant flames increases to facilitate the introduction of secondary air.

Upon ignition, the outer wing 767 corresponding to the igniter 50 in conjunction with the bent portions 765*a* and 767*a* increases a temporary accumulation of the gas-and-air mixture behind the flame holder 760 while inhibiting its jetting speed. In doing so, the largest accumulation of the gas-and-air mixture occurs behind the outer wing 767 to facilitate the initial ignition and thereby enhance an initial ignition power. Thus, the flame holder 760 according to the present invention enhances the initial ignition property.

In the operation of a laundry dryer adopting the present invention, drying is performed through a combustion of gas to heat the air flowing into the drying chamber. To this end, gas is injected via the gas nozzle 22 into the internal passage 240 of the mixing pipe 24 to be mixed with primary air entering the mixing pipe. Upon exiting the mixing pipe 24, the gas-and-air mixture diverges to be jetted from the center flame hole 762 of the flame holder 760 and around the annular hub 761. The thus jetted mixture is ignited by the igniter 50 while continuing its divergent path through the center flame hole 762 and outer flame holes 763 and through gaps created by the outer wings 765 and 767 and the inner wings 764*a* and 764.

Accordingly, the flame holder 760 of the gas combustion apparatus of the present invention separates the gas-and-air mixture into a variety of jetted streams having a complex geometrical configuration, so that the overall length of the flame is shortened and the contact area with secondary air is increased to enhance a mixing effect to accelerate combustion to provide a complete combustion of the gas to thereby generate a stable, blue flame of high temperature. By achieving a shortening of the flame, the present invention prevents lifting and overheating conditions. At the same time, the flame holder 760 also acts as a partition between the interior of the mixing passage 240 and the exit side of the mixing pipe 24, to prevent the backfiring of the flame, thereby preventing the flame from becoming unstable due to external influences.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A laundry dryer having a gas combustion apparatus, the apparatus comprising:

a mixing pipe, having a mixing passage extending from an inlet end to an outlet end adapted to mix gas with primary air, the primary air and gas entering the mixing passage at the inlet end and a gas-and-air mixture exiting the mixing passage at the outlet end;

a flame holder, disposed at the outlet end of said mixing pipe adapted to seperate the gas-and-air mixture exiting said mixing pipe into a complex plurality of jetted streams, the flame holder comprising an annular hub having a center flame hole and a plurality of outer wings radiating from the annular hub; and an igniter disposed adjacent the outlet end of said mixing pipe, wherein the igniter is adapted to ignite the gas-and-air mixture of said mixing pipe, wherein at least one of said outer wings has a circumferential width that is greater than the circumferential width of any other outer wing of said outer wings, and wherein said igniter is disposed adjacent said at least one outer wing.

2. The laundry dryer as claimed in claim 1, wherein said annular hub has a plurality of outer flame holes formed at a predetermined interval around said center flame hole.

3. The laundry dryer as claimed in claim 2, further comprising a pair of support arms, extending from opposites sides of said annular hub, to be fixed to an outer surface of said mixing pipe so that said flame holder is disposed at a predetermined distance forward of the outlet end of said mixing pipe.

4. The laundry dryer as claimed in claim 2, wherein each of the plurality of outer flame holes of said annular hub is aligned with one of said outer wings.

5. The laundry dryer as claimed in claim 2, wherein said outer wings radiate from said annular hub at intervals corresponding to the interval of the outer flame holes of said annular hub.

6. The laundry dryer as claimed in claim 5, wherein at least one of said outer wings has a circumferential width of at least twice the circumferential width of any other outer wing of said outer wings.

7. The laundry dryer as claimed in claim 1, wherein said flame holder is disposed at a predetermined distance forward of the outlet end of said mixing pipe.

8. The laundry dryer as claimed in claim 1, wherein said mixing pipe is inclined at a predetermined angle upward with respect to a base, from the inlet end to the outlet end, to facilitate propagation of a flame.

9. The laundry dryer as claimed in claim 1, wherein the mixing passage of said mixing pipe has a circular cross-section that tapers from the outlet end to the inlet end.

10. The laundry dryer as claimed in claim 1, further comprising means for supplying gas, said gas supplying means comprising:

a valve for controlling the supplied gas; and a gas nozzle, disposed at the inlet end of said mixing pipe, for injecting the supplied gas into said mixing pipe according to the control of said valve.

11. A laundry dryer having a gas combustion apparatus, the apparatus comprising:

a mixing pipe having a mixing passage extending from an inlet end to an outlet end adapted to mix gas with primary air, the primary air and gas entering the mixing passage at the inlet end and a gas-and-air mixture exiting the mixing passage at the outlet end;

a flame holder disposed at the outlet end of said mixing pipe adapted to separate the gas-and-air mixture exiting said mixing pipe into a complex plurality of jetted streams, the flame holder comprising an annular hub having a center flame hole and a plurality of outer wings radiating from the annular hub; and an igniter disposed adjacent the outlet end of said mixing pipe, wherein the igniter is adapted to ignite the gas-and-air mixture of said mixing pipe, wherein said annular hub has a plurality of outer flame holes formed at a predetermined interval around said center flame hole, and wherein at least one of the outer flame holes has a circumferential length that is greater than a diameter of any other outer flame hole of said outer flame holes, and wherein said igniter is disposed adjacent said at least one outer flame hole.

12. A laundry dryer having a gas combustion apparatus, the apparatus comprising:

a mixing pipe, having a mixing passage extending from an inlet end to an outlet end adapted to mix gas with primary air, the primary air and gas entering the mixing passage at the inlet end and a gas-and-air mixture exiting the mixing passage at the outlet end;

a flame holder, disposed at the outlet end of said mixing pipe adapted to separate the gas-and-air mixture exiting said mixing pipe into a complex plurality of jetted streams, the flame holder comprising an annular hub having a center flame hole and a plurality of outer wings radiating from the annular hub; and an igniter disposed adjacent the outlet end of said mixing pipe, wherein the igniter is adapted to ignite the gas-and-air mixture of said mixing pipe, wherein said annular hub has a plurality of outer flame holes formed at a predetermined interval around said center flame hole, and wherein said outer wings respectively comprise a plurality of bent portions formed at distal ends of said outer wings to be directed back toward said mixing pipe, each of said bent portions being inclined at a predetermined angle with respect to a central axis of said mixing pipe and said annular hub.

13. The laundry dryer as claimed in claim 12, wherein the predetermined angle is between 10° and 30°.

14. A laundry dryer having a gas combustion apparatus, the apparatus comprising:

a mixing pipe having a mixing passage extending from an inlet end to an outlet end adapted to mix gas with primary air, the primary air and gas entering the mixing passage at the inlet end and a gas-and-air mixture exiting the mixing passage at the outlet end;

a flame holder disposed at the outlet end of said mixing pipe adapted to separate the gas-and-air mixture exiting said mixing pipe into a complex plurality of jetted streams, the flame holder comprising an annular hub having a center flame hole and a plurality of outer wings radiating from the annular hub; and an igniter disposed adjacent the outlet end of said mixing pipe, wherein the igniters is adapted to ignite the gas-and-air mixture of said mixing pipe, wherein said annular hub has a plurality of outer flame holes formed at a predetermined interval around said center flame hole, said annular hub comprising:

a rounded inner edge protruding forwardly from a perimeter of the center flame hole; and a plurality of inner wings extending from an inner circumference of said rounded inner edge.

15. The laundry dryer as claimed in claim 14, said inner wings comprising:

a plurality of rearward bosses, each having a predetermined length extending directly toward said mixing pipe; and a plurality of inward bosses extending toward the center of said annular hub, wherein circumferential widths of said rearward and inward bosses fully occupy the inner circumference of said rounded inner edge.

16. The laundry dryer as claimed in claim 15, wherein said inward bosses are respectively disposed between said outer wings.

17. The laundry dryer as claimed in claim 16, wherein each of the plurality of outer flame holes of said annular hub is aligned with one of said outer wings.

* * * * *